US005954556A

United States Patent [19]

Powers

[11] Patent Number: 5,954,556

[45] Date of Patent: Sep. 21, 1999

[54] EMERGENCY FLOTATION DEVICE

[76] Inventor: William C. Powers, 2352 Locust Rd., Columbia, S.C. 29223

[21] Appl. No.: 09/167,944

[22] Filed: Oct. 7, 1998

[51] Int. Cl.[6] ..... B63C 9/08

[52] U.S. Cl. ..... 441/88; 441/96; 441/98; 441/108; 441/114

[58] Field of Search ..... 441/94, 96, 98, 441/99, 108, 113, 88, 114

[56] References Cited

U.S. PATENT DOCUMENTS

| | | | |
|---|---|---|---|
| 2,895,147 | 7/1959 | Besjarlais et al. | 441/96 |
| 3,119,132 | 1/1964 | Nayar | 441/96 |
| 4,360,351 | 11/1982 | Travinski | 441/108 |
| 4,626,221 | 12/1986 | Rocco | 441/108 |
| 5,180,321 | 1/1993 | Brown | 441/94 |
| 5,348,504 | 9/1994 | Pierce et al. | 441/113 |
| 5,382,184 | 1/1995 | DiForte, Jr. | 441/108 |
| 5,456,623 | 10/1995 | Norris | 441/92 |
| 5,466,179 | 11/1995 | Jeffrey, Sr. | 441/108 |

*Primary Examiner*—Jesus D. Sotelo
*Attorney, Agent, or Firm*—Henderson & Sturm

[57] ABSTRACT

An inflatable life saving belt comprising a gas source linked to a reusable inflatable bag at multiple locations on the belt. The bags are attached to the gas source in a manner such that should one of the bags fail to deploy, the other bags can be activated.

4 Claims, 2 Drawing Sheets

EMERGENCY FLOTATION DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of flotation devices, and more particularly to a flotation device that is automatically or manually activated to inflate flotation bags.

2. Description of Related Art

As can be seen by reference to the following U.S. Pat. Nos. 5,466,179; 5,456,623; 5,382,184; 4,626,221; 5,180,321; and 5,348,504 the prior art is replete with myriad and diverse flotation devices.

While all of the aforementioned prior art constructions are more than adequate for the basic purpose and function for which they have been specifically designed, they are uniformly deficient with respect to their failure to provide a simple, efficient, and practical flotation device that can be automatically or manually activated when an emergency situation arises.

As a consequence of the foregoing situation, there has existed a longstanding need for a new and improved emergency flotation device and the provision of such a construction is a stated objective of the present invention.

BRIEF SUMMARY OF THE INVENTION

Briefly stated, the present invention provides an inflatable life saving belt comprising a gas source linked to a reusable inflatable bag at multiple locations on the belt. The bags are attached to the gas source in a manner such that should one of the bags fail to deploy, the other bags can be activated.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
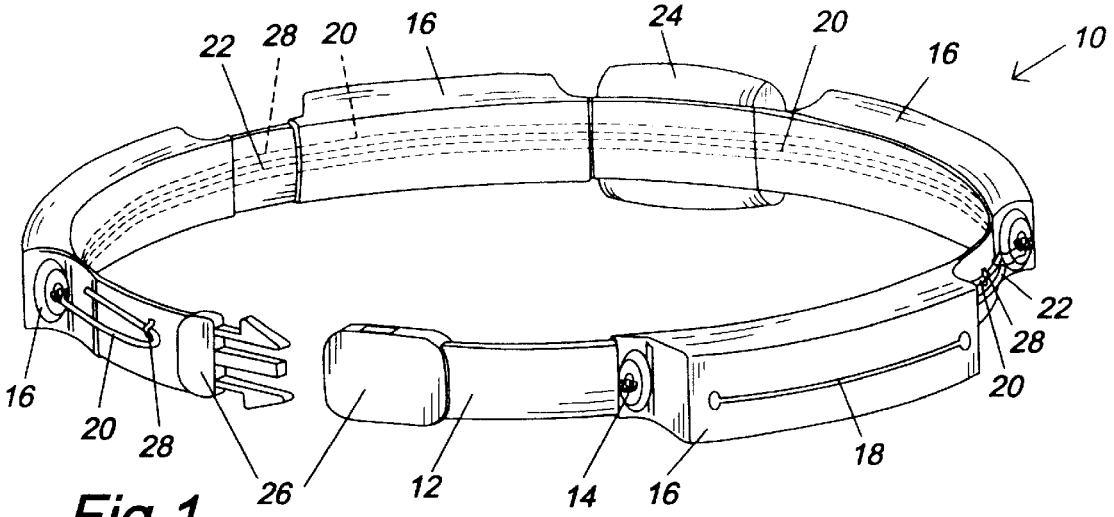
FIG. 1 is a perspective view of the emergency flotation device of the present invention in the unactivated mode.

As can be seen by reference to the drawings, and in particularly to FIG. 1, the emergency flotation device that forms the basis of the present invention is designated generally by the reference number 10.

The emergency flotation device 10 includes the base frame nylon belt component 12 which has fixtures or attachments which allows attachment of the following parts; the pull cord ring 14, the flotation bag storage compartment 16, the flotation release slit 18, the pull cord 20, the vinegar line 22, the pressurized vinegar container 24, the buckle/locking mechanism 26, and the pull cord with associated cord guide 28.

Figure 2:
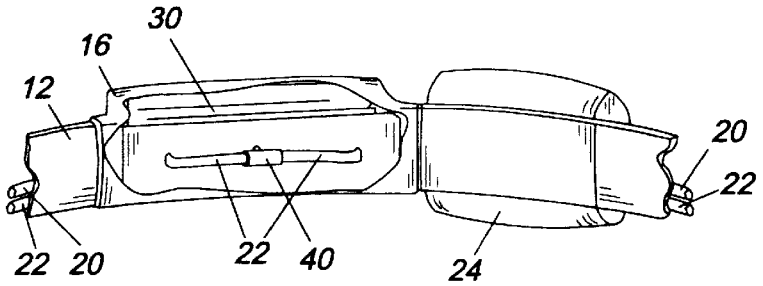
FIG. 2 is a partial perspective view with portions cut away to show internal components.
Figure 3:
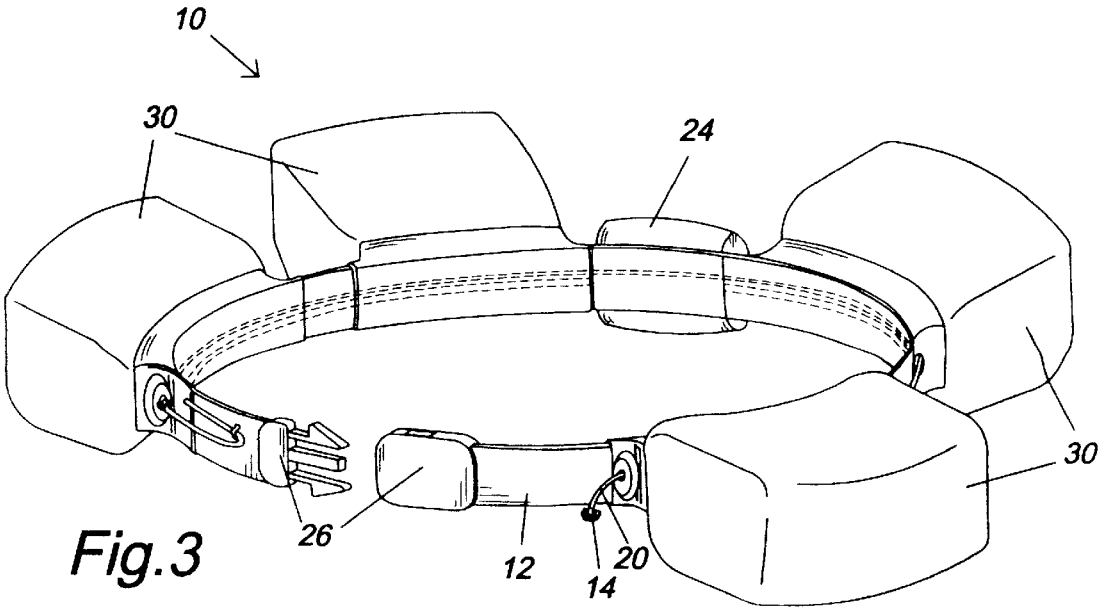
FIG. 3 is a perspective view of the emergency flotation device similar to FIG. 1, but showing the device in the activated mode.

FIGS. 2 and 3 further illustrate in detail the technical relationship of the base frame nylon belt component 12, and the flotation bag storage container 16, the flotation bags 30, the pull cord 20, the vinegar lines 22, the vinegar container 24, the "T" Fitting 40, the buckle/locking mechanism 26, and the pull cord ring 14.

The design of the emergency flotation device 10 is that of an emergency pop-out flotation belt system that is worn around the waist area of a person and may be easily and quickly inflated. The emergency flotation device 10 is belt-like in appearance with a front located "quick-release" buckle 26 that provides a positive blocking safety system and rapid deployment of the emergency flotation device 10.

Figure 4:
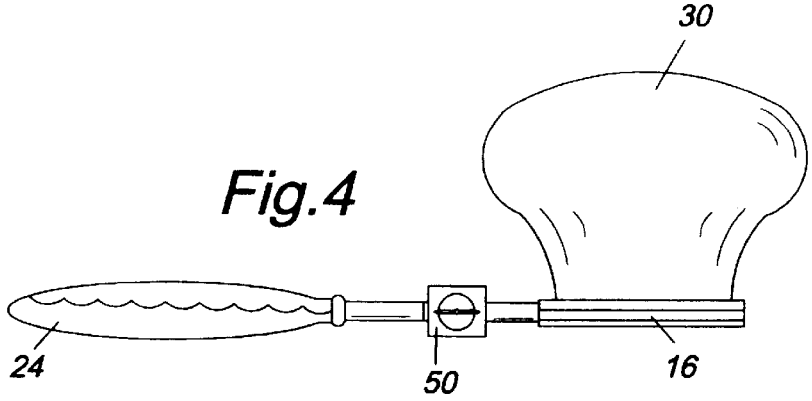
FIG. 4 is a schematic view illustrating the inflation of a bag by activation of the gas source comprising the vinegar-baking soda combination.

As illustrated in FIG. 4, a pressurized cylinder 24 containing vinegar is located in the lower belt component and is directly connected to a closed valve system 50 which keeps the pressurized vinegar from reaching its "target" destination. The target destination is series of low-profile containers 16 placed around the belt portion of the emergency flotation device 10. Each of the four containers 16 has baking soda granules enclosed. Surrounding the container 16 is a compact, tightly folded, pleated balloon 30. Under operation, a valve 50 for each of the four containers 16 is activated in one of two ways; either by the pressure exerted when someone falls into the water allowing the valve to automatically open due to the pressure similar to other emergency inflating devices currently in use; or manually by the individual wearing the emergency flotation device 10 by means of pulling the associated cord 20 that attaches to a ring 14 allowing the valve 50 on each of the four devices to open, releasing the pressurized vinegar. When the pressurized vinegar is allowed to flow into the contained areas which houses the granular baking soda, and internal spray head, which traverses the interior of the device, equally sprays vinegar throughout the entire container at once, causing the instant release of gas created when the two components meet. Once the gas is formed, all four of the folded, compacted vinyl flotation balloons 30 instantly expand because of the generation of the forming gas.

In actual physical construction, it may be seen in FIG. 1 that the containers 16 have a thin vinyl protective cover which has a scored surface 18. This thin vinyl membrane keeps dirt and unwanted material out of the interior of the emergency flotation device 10, while still allowing the flotation balloon 30 to deploy very easily and rapidly due to the thin scored nature of the protective sheet.

As previously mentioned, the belt component 12 houses the pressurized vinegar container 24 that feeds the liquid vinegar to all four of the inflating devices surrounding the belt portion of the emergency flotation device 10. Each of the four inflation devices 30 has its own valve system 50, with tubing from the pressurized vinegar container feeding each valve 50. The pull cord 20 is commonly attached to each of the valves 50, opening all of them at the same time whenever the pull cord 20 is manually activated.

Figure 5:
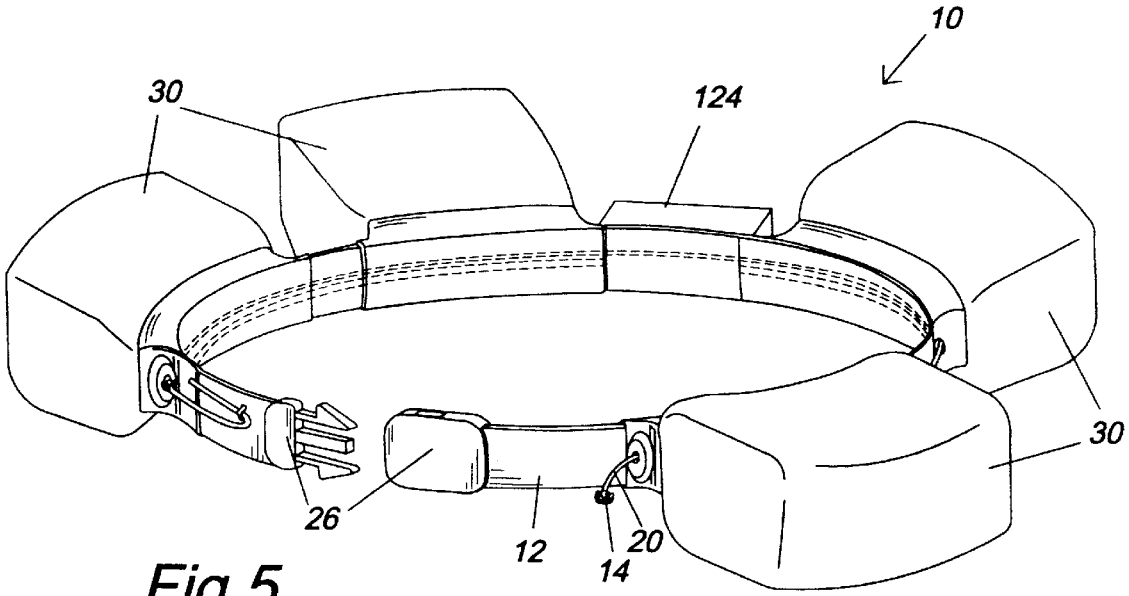
FIG. 5 is a perspective view of another embodiment of the emergency flotation device using a $CO_2$ cartridge assembly.
Figure 6:
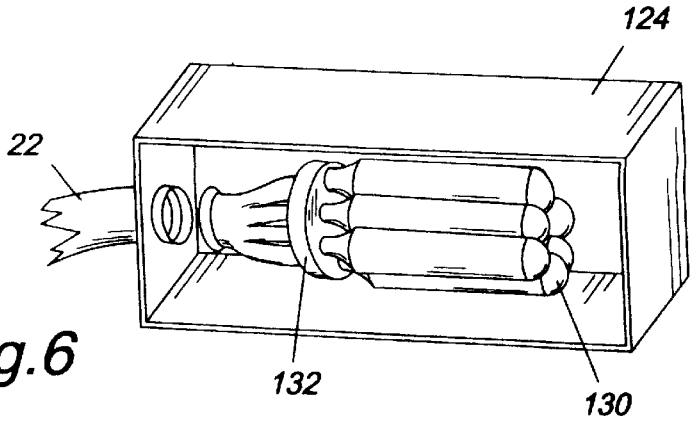
FIG. 6 is an enlarged perspective view illustrating the $CO_2$ cartridge assembly.

FIGS. 5 and 6 show an alternate embodiment of the emergency flotation device 10 which replaces the pressurized vinegar container 24 with a $CO_2$ assembly 124. The $CO_2$ assembly consists of several $CO_2$ cartridges 130 connected to a common manifold 132. The common manifold 132 allows the use of off-the-shelf $CO_2$ cartridges 130 and provides an increase in the volume of $CO_2$ available to inflate all of the flotation bags 30 attached to the belt component 12. Use of the pressurized $CO_2$ eliminates the need for baking soda granules, while still keeping all the other components in tact. This method allows the $CO_2$ cartridge assembly 124 to inflate the flotation balloons 30 under its own pressure. The overall design of the emergency flotation device 10 lends itself to this particular engineering flexibility.

In use, the user connects the front buckle 26 in order to wear and make use of the emergency flotation device 10. To use the emergency flotation device 10 during an emergency, i.e., boating, swimming, or water skiing accident, the user pulls the ring 14 which deploys the flotation bags 30. When the user becomes submerged under approximately 20 feet of water, a depth valve/sensor gauge automatically deploys the flotation bags 30 surrounding the belt. After use, the user discards the used unit or sends it to the factory for recycling.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An emergency flotation device, comprising:

a belt adapted to be positioned around a waist of a user;

a plurality of containers attached to and spaced around the belt, each container including a sealed weakened section;

an inflatable balloon disposed within each of the containers;

a gas chamber containing a gas source attached to the belt and disposed in fluid communication with each of the inflatable balloons;

a valve disposed between the gas source and each of the inflatable balloons, the valve being operable to prevent flow from the gas source to the inflatable balloons;

an operator cord disposed within the belt and connected to each of the valves, the operator cord having a free end accessible to the user, wherein pulling of the cord by the user opens the valve to allow flow from the gas source to the inflatable balloons, whereby the inflated balloons break through the sealed weakened section of the container to an inflated mode positioned around the belt.

2. The emergency flotation device of claim 1 wherein the gas source includes pressurized vinegar held within the chamber and baking soda disposed within the inflatable balloons.

3. The emergency flotation device of claim 1 wherein the gas source includes pressurized $CO_2$.

4. The emergency flotation device of claim 1 wherein four inflatable balloons are positioned in spaced relation around the belt to provide balanced support for the user.

* * * * *